US005740926A

United States Patent [19]

Mulloy

[11] Patent Number: 5,740,926

[45] Date of Patent: Apr. 21, 1998

[54] BOOKSHELF WITH ADJUSTABLE LOCKING BOOKENDS

[76] Inventor: Bernard J. Mulloy, 2092 128th Ave., Hopkins, Mich. 49328

[21] Appl. No.: 770,665

[22] Filed: Dec. 20, 1996

[51] Int. Cl.[6] ..... A47B 65/00

[52] U.S. Cl. ..... 211/43; 108/28

[58] Field of Search ..... 211/43, 51, 184; 108/61

[56] References Cited

U.S. PATENT DOCUMENTS

| | | | |
|---|---|---|---|
| 113,830 | 4/1871 | Anderson . | |
| 1,898,533 | 2/1933 | Harriman | 211/51 |
| 2,569,622 | 10/1951 | Trainor . | |
| 2,684,765 | 7/1954 | Lowenstein, Jr. . | |
| 3,138,262 | 6/1964 | Anders . | |
| 3,301,407 | 1/1967 | Jones | 108/61 |
| 3,465,896 | 9/1969 | Cafiero et al. . | |
| 3,487,945 | 1/1970 | Barham . | |
| 4,113,108 | 9/1978 | Anderson . | |
| 4,682,696 | 7/1987 | Sheu . | |
| 4,874,099 | 10/1989 | Arnott et al. . | |
| 4,878,640 | 11/1989 | Fricker et al. . | |
| 5,154,385 | 10/1992 | Lindberg et al. . | |
| 5,325,792 | 7/1994 | Molloy . | |

FOREIGN PATENT DOCUMENTS

| | | | |
|---|---|---|---|
| 611044 | 9/1926 | France | 211/43 |

*Primary Examiner*—Peter R. Brown
*Assistant Examiner*—Gerald A. Anderson
*Attorney, Agent, or Firm*—Young & Basile, PC

[57] ABSTRACT

A bookshelf has a longitudinally extending slot formed therein. At least one book support member is movably mounted on a top surface of the bookshelf. A lock assembly is carried in the book support member and has a first actuator extending externally from one end of the book support member to facilitate rotation of the lock assembly, and a second opposed end movably disposed within the slot in a shelf. Rotation of the actuator effects rotation of a drive rod connected to the actuator at one end and to a nut at an opposite end. Outwardly extending legs on the nut are engagable with the shelf to fixedly lock the bookend to the shelf. Rotation of the actuator in an opposite direction releases the legs from engagement with the shelf to enable selective repositioning of the bookend along the shelf.

10 Claims, 4 Drawing Sheets

BOOKSHELF WITH ADJUSTABLE LOCKING BOOKENDS

CROSS REFERENCED TO RELATED PROVISIONAL APPLICATION

This application claims the benefit of the U.S. Provisional Application Ser. No. 60/009,110, filed Dec. 20, 1995 in the name of Bernard J. Mulloy and entitled "Bookshelf With Adjustable Bookends".

BACKGROUND OF THE INVENTION

The present invention relates, in general, to article holding devices and, specifically, to holders for supporting books, files, papers and the like on a shelf and, more specifically, to adjustable book holders which are movably and lockingly positionable along a bookshelf.

DESCRIPTION OF THE ART

Bookshelves are extensively used to support books, files, magazines, folders and the like in a generally upright, side-by-side position with the spine or edges of such books extending upward from the shelf. The shelf itself is typically a horizontal member extending between two fixed end walls which may be part of the elongated side walls of a bookcase which supports a number of vertically spaced, horizontal shelves.

Frequently, and sometimes intentionally, fewer books than the total number of books which would fill the shelf are placed on the shelf between the two end walls. In order to maintain such books in a generally upright position, at least one bookend is placed on the shelf and brought into engagement with the end(s) of the horizontal row of books to support the books in an upright position. Such bookends can be free-standing so as to be easily positionable anywhere along the length of the bookshelf. However, such free-standing bookends must be large and/or heavy so as to provide adequate support for the books. Such large size or weight, however, make such bookends difficult to easily move along the shelf.

Thus, lockable bookends have been devised which slide along tracks formed in the shelf to any position along the shelf and are locked in a desired position tightly against the end of a horizontal row of books. The lock means employed in such adjustable bookends must meet a number of different functions.

First, the lock means must be strong enough to securely retain the bookend in a fixed place despite the weight of the row of books, files, etc., pushing thereon without permitting movement of the bookend. Secondly, the lock means must be easily releasable, preferably by finger pressure, to enable anyone to easily unlock and move the bookend to another position along the bookshelf. Thirdly, the adjustable bookend must be simple in construction for a low manufacturing cost, ease of installation and long term, reliable use. Previously devised adjustable bookends have not sufficiently met all of these functions.

A prior attempt by the applicant to meet these functions is disclosed in U.S. Pat. No. 5,325,792. This patent discloses a bookshelf having a longitudinal guideway with a channel structure attached to the shelf within the guideway. The channel structure includes at least one row of spaced, open-ended apertures. A base is connected to a planar book support member and has a moveable lock bar extending therethrough. A cross bar is attached to the end of the lock bar and is urged by a biasing spring to a first position in which the cross bar securely engages one of the apertures in the channel to lock the base and the attached book support member in a selected position along the length of the shelf.

While applicant's above-described, prior bookshelf with adjustable bookends effectively meets all of the above-listed functions required for an adjustable bookend, it has been found that further improvements could be made to the bookshelf with adjustable bookend which would make the bookshelf with adjustable bookends less expensive and easier to manufacture, and, further, adaptable to existing shelves without significant modification to such existing shelves.

SUMMARY OF THE INVENTION

The present invention is a bookshelf with at least one lockingly adjustable, repositionable bookend mounted thereon.

In a preferred embodiment, the bookshelf includes a shelf having top and bottom surfaces and opposed longitudinally spaced first and second ends. A longitudinal slot is formed in and extends longitudinally between the first and second ends of the shelf. A book support member is movably disposed on the top surface of the shelf. Lock means, carried in the book support member and releasably engagable with the slot in the shelf, releasably locks the book support member in a selectively adjustable position along the length of the shelf.

In one embodiment, the first and second ends of the slot are spaced from the first and second ends of the shelf which constitutes a single, one-piece rigid member. In another embodiment, the shelf is formed of first and second separate shelf portions, each with opposite ends. The first and second shelf portions are fixedly spaced apart by end plates joined to aligned first ends and aligned second ends of the first and second shelf portions to form a slot extending longitudinally along the joined first and second shelf portions.

A transverse slot extends laterally outward from opposite sides of the longitudinal slot into the shelf or shelf portions and extends longitudinally along the length of the slot. The lock means has an end disposed in the transverse slot. The lock means further includes a rotatable member carried in the book support member and having a actuator or rotatable member extending externally of the book support member. The lock means further includes a lock member and means carried on the rotatable member and the lock member for extensibly connecting the lock member to the rotatable member for extensible movement of the lock member relative to the shelf upon rotation of the rotatable member.

In one embodiment, the book support member is in the form of a single one-piece planar member with a bore extending therethrough to receive the lock means. Grip means may be formed on the planar member to facilitate gripping of the planar member to effect slidable adjustment of the planar member along the length of the shelf. In another embodiment, the book support member includes a first planar book support member and a second support member fixedly joined to the first support member. A bore is formed between the facing surfaces of the first and second support members for receiving the lock means.

The combined bookshelf with adjustable bookends of the present invention has a simplified construction for a low manufacturing cost, ease of manufacture, ease of use and long term reliability. The lock means employed in the combined bookshelf of the present invention provides sufficient force to securely retain the bookend(s) in a selected position along the bookshelf to support books or other articles in a generally upright position on the shelf; yet, at the same time, the lock means is easily releasible by finger pressure to enable repositioning of the bookend along the shelf.

In one embodiment, the lock means engages a slot formed in the shelf, with opposite ends of the slot spaced inward from opposite ends of the shelf. This enables the present invention to be employed with any existing shelf by merely forming the slot in the shelf. The bookend and the lock means may then be easily mounted in the slot to provide the desired selectively repositionable bookends on the shelf.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENT

Figure 1:
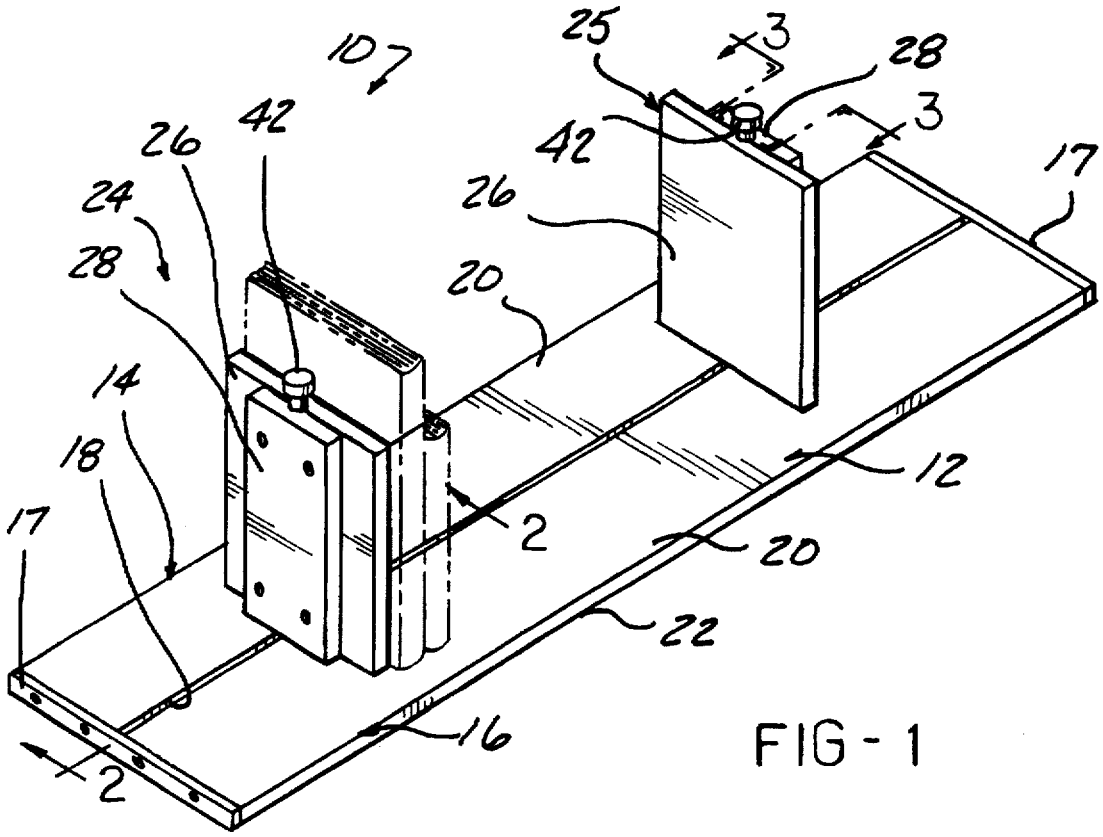
FIG. 1 is a perspective view of a bookshelf with adjustable bookends constructed in accordance with the teachings of one embodiment of the present invention.

Referring now to the drawing, and to FIG. 1 in particular, there is illustrated a bookshelf with adjustable locking bookends constructed in accordance with the teachings of the present invention. The combined bookshelf with adjustable bookends, denoted generally by reference number 10, is designed to hold books in a generally upright position. The term "books" means books, both hardcover and paperback, magazines, files of any type, phonograph records, photo albums and the like. The term "bookshelf", as used herein, means a horizontal surface used to support books in a generally upright, side-by-side position. The bookshelf may be stationarily mounted in a larger book case, free-standing and mountable on brackets attached to a wall, or portable so as to be removably placed on a movable cart, stand, desk, etc.

The combined bookshelf with adjustable bookends 10 includes a shelf 12 which is formed of a first shelf section 14 and a second identical shelf section 16. The first and second shelf sections 14 and 16 are of identical size and are spaced apart by tie straps 17 fixed by fasteners to the ends of the shelf sections 14 and 16 to form a longitudinal guideway 18 between spaced side edges of the shelf sections 14 and 16. The first and second shelf sections 14 and 16 also have a top surface denoted by reference number 20 and an opposed bottom surface 22 with the side edges extending therebetween.

Figure 3:
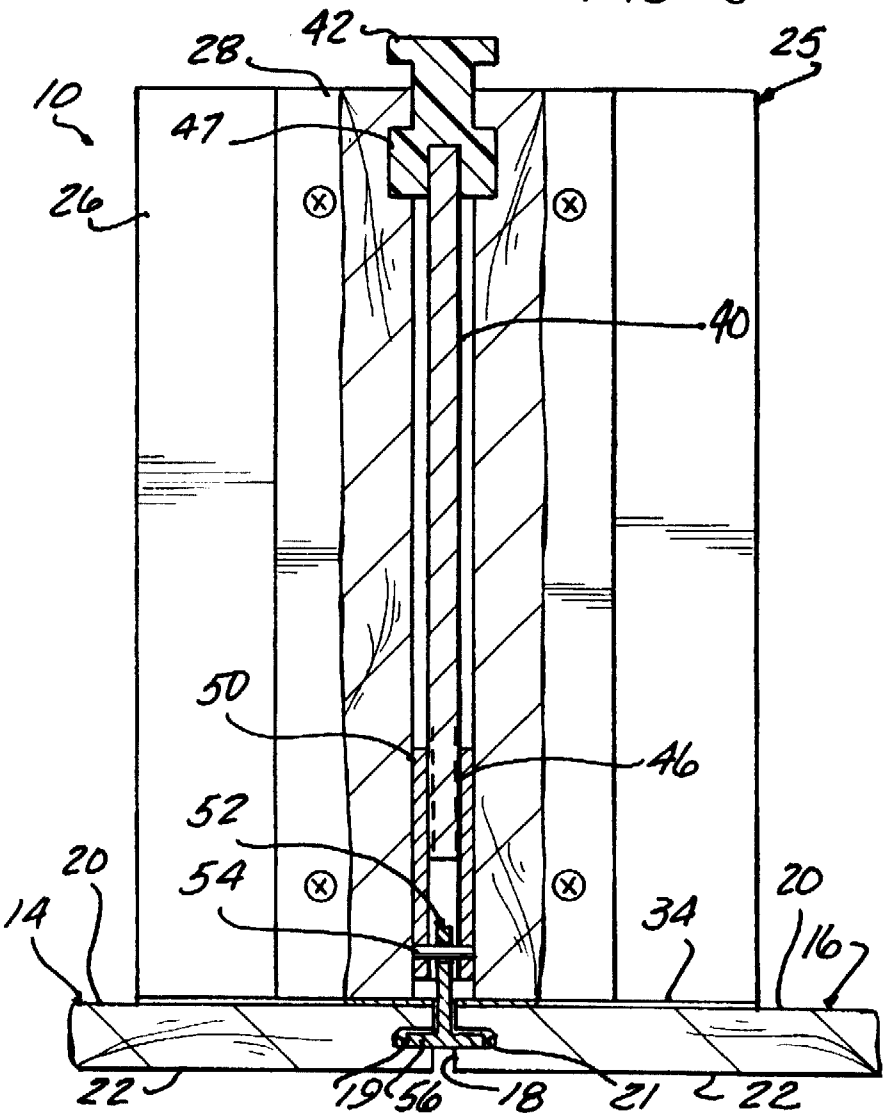
FIG. 3 is a cross sectional view generally taken along line 3—3 in FIG. 1.
Figure 2:
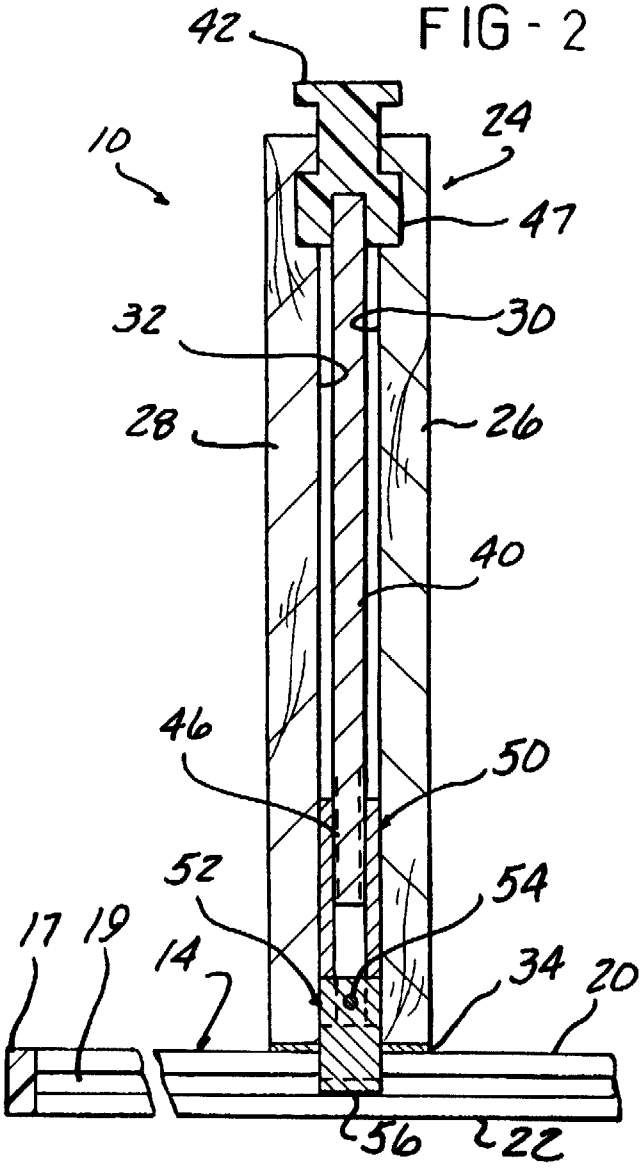
FIG. 2 is a cross sectional view generally taken along line 2—2 in FIG. 1.

Lateral grooves 19 and 21 are formed in facing side edges of the first and second shelf sections 14 and 16, respectively, as shown in FIGS. 2 and 3.

The first and second shelf sections 14 and 16 may be formed of any suitable material, such as wood, plastic, metal, etc. In a preferred embodiment, the first and second shelf sections 14 and 16 are formed of wood, such as natural wood or composite fiberboard which is covered by a plastic laminate of any color or pattern.

The combined bookshelf with adjustable bookends 10 includes at least one and preferably two adjustably positionable bookends 24 and 25. As each of the bookends 24 and 25 is identically constructed, the following description will be understood to apply to each of the bookends 24 and 25.

As shown in FIGS. 1–3, the bookend 24 includes a generally planar book support member or front platen 26 which is disposed above the top surface 20 of the shelf sections 14 and 16. The front platen 26 has a generally rectangular shape, by way of example only, and may be formed of any suitable material, such as metal, wood, plastic laminate covered wood, etc.

A rear platen 28 is attached to one side of the front platen 26 by any suitable means, such as fasteners, adhesive, etc. The rear platen 28 also has a generally rectangular shape and is likewise formed of metal, wood, plastic laminate covered wood, etc.

As shown in FIGS. 2 and 3, elongated slots 30 and 32, each having a stepped configuration, are formed in the facing sides of the first and rear platens 26 and 28 and are aligned to form an elongated, stepped bore between the front and rear platens 26 and 28.

A rest pad 34, shown in FIGS. 2 and 3 is mounted by fasteners, adhesives, etc. on the bottom surface of the front and rear platens 26 and 28. The rest pad 34 is formed of a suitable low friction material, such as plastic, to provide easy sliding movement of the bookends 24 and/or 25 along the shelf 12 during selective positioning of the bookends 24 and/or 25 on the shelf 12. The rest pad 34 is provided with a central aperture, the purpose of which will become more apparent hereafter.

The combined bookshelf with adjustable bookends 10 includes a lock means for releasably locking each of the bookends 24 and 25 in an adjustably selected position along the length of the shelf 12.

Figure 4:
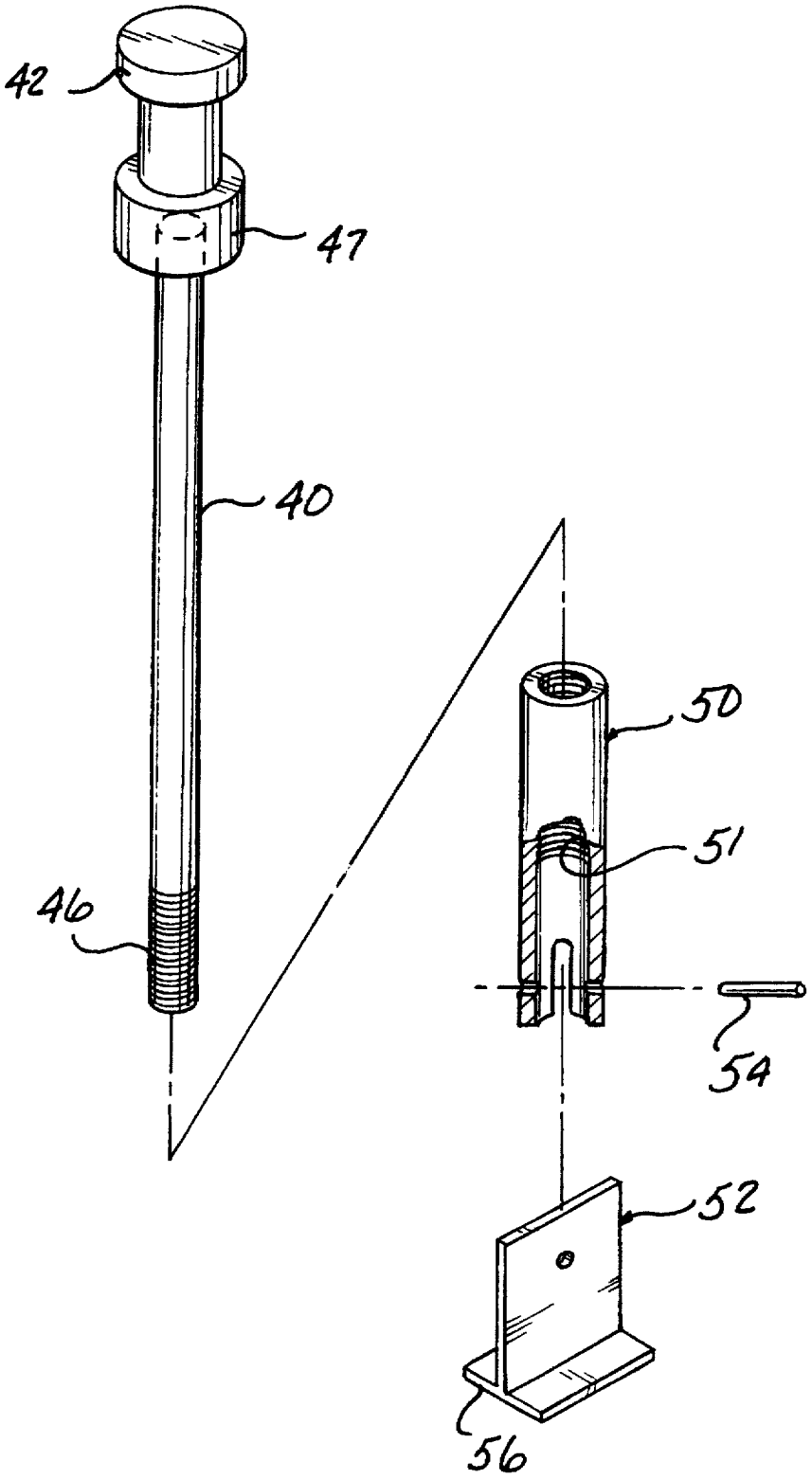
FIG. 4 is an exploded, perspective view showing the control knob, drive-rod, clevis and keeper of the present invention.

As shown in detail in FIGS. 2–4, an elongated drive rod 40 is slidably mounted in the bore formed between the front and rear platens 26 and 28 of each of the bookends 24 and 25. A control knob or button 42 is attached to the upper end of the drive rod 40. In an exemplary embodiment, control knob 42 is integrally formed as part of the drive rod 40. The control knob 42 enables manual rotation of the drive rod 40 in each bookend 24 and 25.

By way of example only, the drive rod 40 has a circular cross section and is preferably formed of metal. An opposite end 46 of the drive rod 40 is threaded as seen in FIGS. 2–4.

A retainer 47, shown in FIGS. 2, 3 and 4, is fixed to an intermediate portion of the drive rod 40, such as by integral casting as a one piece casting with the drive rod 40. The retainer 47 is disposed within an enlarged portion of the stepped bore between the front and rear platens 26 and 28 and acts as a stop to linear movement of the drive rod 40 via engagement with surfaces of the enlarged portion of the stepped bore.

A clevis 50, shown in detail in FIGS. 2–4, has a tubular configuration with a threaded internal bore 51 formed extending from one end and receiving the threaded end 46 of the drive rod 40. The other end of the bore 51 is formed as a slot for receiving a keeper 52 which is fixed to the clevis 50 by a roll pin 54 extending through a lateral bore in the clevis 50 and an aperture in the keeper 52.

The keeper 52, which is by example formed as an aluminum extrusion, has an inverted T shape with a stem 54 and a cross leg 56 extending outward from one end of the stem 54. The ends of the cross leg 56 slide within the grooves 19 and 21 in the shelf sections 14 and 16, respectively.

In operation, rotation of the control knob 42 in a counterclockwise direction will rotate the drive rod 40 and cause the clevis 50 to extend longitudinally with respect to the drive rod 40. This moves the cross leg 56 of the keeper 52 out of engagement with the inner surfaces in the shelf sections 14 and 16 of the grooves 19 and 21 and frees the bookend 24 or 25 for movement along the shelf 12. Rotation of the control knob 42 in an opposite or clockwise direction will draw the clevis 50 and the keeper 52 toward the drive rod 40 and bring the cross leg 56 into engagement with the inner surfaces in the shelf sections 24 and 25 of the grooves 19 and 21 to lock the bookend 24 or 25 in a selected position on the shelf 12.

Figure 5:
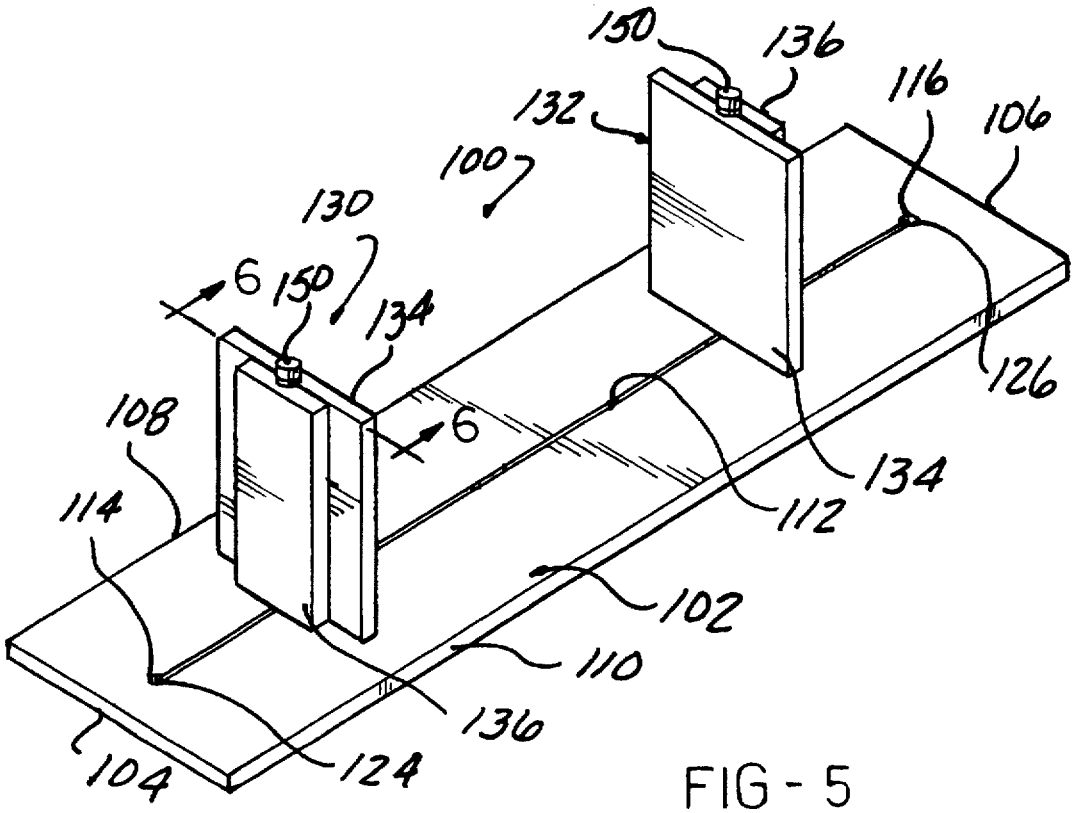
FIG. 5 is a perspective view of another embodiment of a bookshelf with adjustable bookends constructed in accordance with the teachings of the present invention.

Another embodiment of the combined bookshelf with adjustable bookends 100 is shown in FIG. 5. In this embodiment, the combined bookshelf with adjustable bookends 100 includes a one-piece shelf 102 having opposed first and second ends 104 and 106 and opposed longitudinally extending sidewalls 108 and 110. The shelf 102 may be formed of any suitable material, such as metal, wood, plastic, etc. Further, the shelf 102 may be formed of various materials, such as wood or composite fiberboard covered with a plastic laminate outer layer, etc.

A single slot denoted generally by reference number 112 is formed in the shelf 102. The slot 112 has opposed first and second ends 114 and 116 which are respectively spaced from the first and second ends 104 and 106 of the shelf 12.

Figure 6:
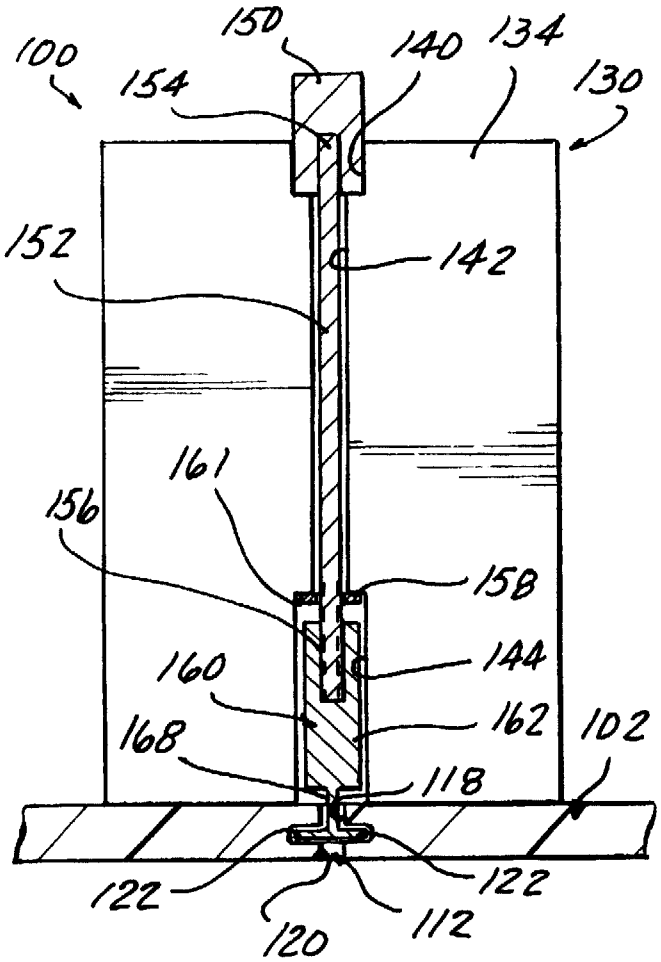
FIG. 6 is a cross-sectional view generally taken along line 6—6 in FIG. 5.

As shown in FIG. 6, the slot 112 includes a first diameter slot 118 extending a short distance from an upper surface of the shelf 102 and a spaced, co-axial larger diameter 120 extending from the opposed surface of the shelf 102. A pair of laterally extending grooves or slots, each denoted by reference number 122, extend laterally outward from, an intermediate position between the co-axial aligned slots 118 and 120. The grooves 122 are located substantially centrally within the thickness of the shelf 102.

The slot 112 is formed in the shelf 102 by first drilling an enlarged diameter bore 124 in the shelf 102 to form the first end 114 of the slot 112. A similar enlarged diameter bore 126 is formed at the second end 116 of the slot 112. The smaller diameter slots 118 and 120 are then formed in the shelf 102 preferably from opposite surfaces of the shelf 102. A suitable router or other tool is then positioned between the slots 118 and 120 to form the laterally extending grooves 122 as shown in FIG. 6.

The combined bookshelf with adjustable bookends 100 includes at least one and preferably two adjustably positionable bookends 130 and 132. As each of the bookends 130 and 132 are identically constructed, the following description of the bookend 130 will be understood to apply equally to the bookend 132.

As shown in FIGS. 5 and 6, the bookend 130 includes a generally planar, book support member or front platen 134 which is disposed above the top surface of the shelf 102. The front platen 134 has a generally rectangular shape, by way of example only, and may be formed of any suitable material, such as metal, wood, plastic laminate covered wood, or composite fiberboard, etc.

A rear platen 136 is attached to one side of the front platen 134 by suitable means, such as fasteners, adhesive, etc., not shown. The rear platen 136 also has a generally rectangular shape and is likewise formed of metal, wood, plastic laminate covered wood, etc. Generally, the rear platen 136 has the same height but a smaller overall width than the front platen 134.

Figure 7:
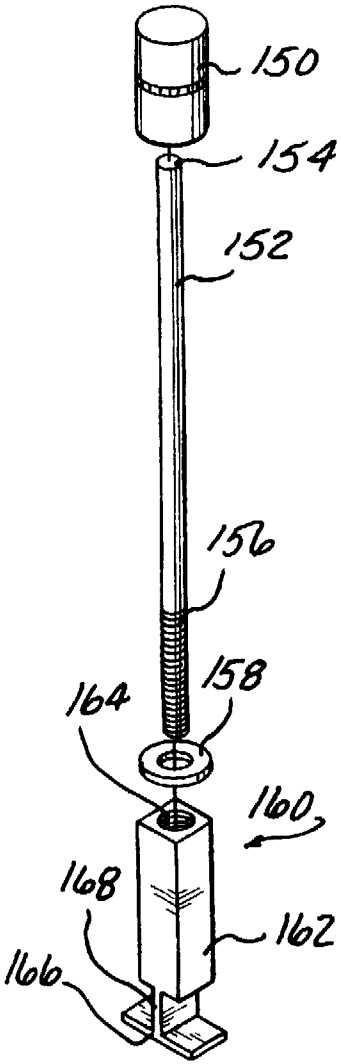
FIG. 7 is an exploded, perspective view of the lock means shown in FIGS. 5 and 6.

A lock means is mounted in the bookend 130 between the front and rear platens 134 and 136, as shown in detail in FIGS. 6 and 7, for releasably locking the bookend 130 in an adjustably selected position along the length of the shelf 102. An elongated, stepped bore is formed in two halves on the facing surfaces of the front and rear platens 134 and 136, with half of the bore formed in each of the front and rear platens 134 and 136. The bore includes a first enlarged bore portion 140 at the top or upper end of the bookend 130. A second smaller diameter bore portion 142 extends from the first bore portion 140. Finally, a third larger diameter bore portion 144 extends from one end of the second bore portion 142 to a lower or bottom end of the bookshelf 130.

An actuator or rotatable member, preferably in the form of a control knob or button 150, is rotatably mounted in the first bore portion 140. The control knob 150 is fixedly mounted to an upper end of an elongated drive rod 152. Alternately, the control knob 150 may be integrally formed as a one-piece molded or machined part of the drive rod 152. The control knob 150 enables manual rotation of the drive rod 152 as described hereafter.

As shown in FIGS. 6 and 7, the drive rod 152 has a generally smooth exterior surface extending from a first end 154 along a substantial portion of the length of the drive rod 152. A threaded portion 156 is formed at the opposite end of the drive rod 152. A retainer or lock nut 158 is fixedly mounted about the drive rod 152 proximate the juncture of the smooth and threaded portions so as to engage a shoulder 161 formed at the juncture of the second and third bore portions 142 and 144. The retainer 158 and the control knob 150 fix the drive rod 152 in a non-linearly movable position within the bookend 130; which still allowing rotation of the drive rod 152 under manual force as described hereafter. Alternately, a spring, not shown, may be used instead of the lock nut 158 and seated between the shoulder 161 and a T-nut 160.

The T-nut 160 is mounted in the third bore portion 144. The T-nut 160 has a generally cubical body 162 with an axially extending bore 164 formed therein and extending from one end for a partial distance through the body 162. The bore 164 is threaded to threadingly receive the threaded end 156 of the drive rod 152. An elongated cross leg 166 is spaced from a bottom end of the body 164 by a thin stem 168. The cross leg 166 is situated within the laterally extending grooves 122 in the slot 112. Outer ends of the cross leg 166 extend laterally outward from the stem 168 so as to engage opposed inner surfaces of the shelf 102 in each groove 122 as shown in FIG. 6.

The overall length of the cross leg 166 is less than the width or diameter of the slot 112 so as to enable the assembled bookend 130 and lock means to be inserted through one of the enlarged diameter apertures 124 or 126 at opposite ends of the slot 112. The bookend 130 is then rotated 90° to align the cross leg 166 in the grooves 122 as shown in FIG. 6.

The bookend 130 may then be longitudinally moved along the length of the shelf 102 to the desired position. The knob 150 is then rotated in a clockwise direction to cause linear movement of the T-nut 160 in an upward direction so as to bring the cross leg 166 into engagement with an inner surface of the shelf 102 within the grooves 122 to fixedly lock the bookend 130 in the selected position. Counterclockwise rotation of the knob 150 will disengage the cross leg 166 from the shelf 102 thereby enabling longitudinal adjustment of the bookend 130 to the next selected position.

Figure 8:
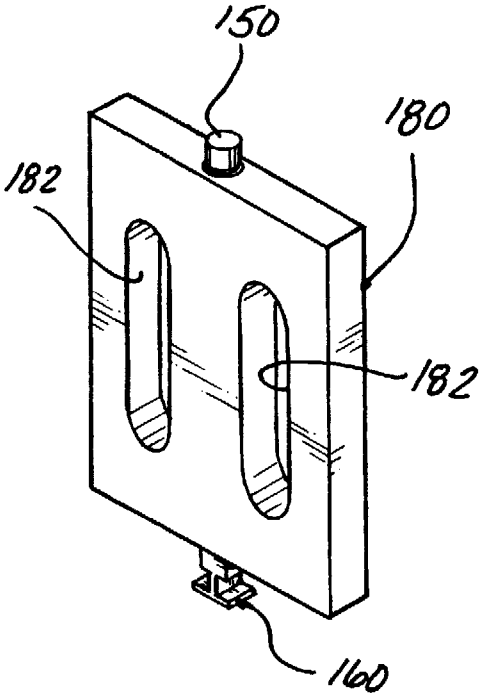
FIG. 8 is a perspective view of an alternate embodiment of an adjustable bookend usable with the bookshelf shown in FIGS. 1 or 5.

FIG. 8 depicts an alternate embodiment of the book support member in which the book support member 180 is formed as a single, one-piece member. The book support 180 has the general configuration of the front platen 134 shown in FIG. 5 except that a bore extends through the book support member 180 to receive the lock means as described above and shown in FIGS. 6 and 7.

The book support member 180 includes at least one and preferably a pair of spaced slots or grooves 182 which function as finger grip means for facilitating easy grasping of the book support member 180 during repositioning of the book support member 180 along the length of the book shelf 102.

In summary, there has been disclosed a unique bookshelf with adjustable bookends which provide a simple, inexpensive, expedient means for supporting a plurality of books or other articles in a side-by-side arrangement between one and preferably two adjustably positionable bookends. The bookends are releasably lockable in any desired position along the length of the shelf to securely retain the books or articles therebetween. The lock means employed on the bookends provides sufficient force to securely retain the bookends in the selected position on the shelf; yet, is easily releasable to enable repositioning of the book ends.

What is claimed is:

1. A bookshelf comprising:

a shelf having top and bottom surfaces and opposed longitudinally spaced first and second ends;

a longitudinal slot formed in and extending longitudinally between the first and second ends of the shelf;

an article support member movably disposed on the top surface of the shelf; and a lock member carried in the article support member and having an end releasably engagable with the longitudinal slot in the shelf, a rotatable member carried in the article support member and having an actuator extending externally of the article support member, and means for extensibly connecting the lock member to the rotatable member for extensible movement of the end of the lock member relative to the shelf upon rotation of the rotatable member for releasably locking the article support member in a selectively adjustable position along the length of the shelf.

2. The bookshelf of claim 1 wherein the longitudinal slot includes first and second ends respectively spaced from the first and second ends, of the shelf.

3. The bookshelf of claim 1 wherein:

the shelf is formed of first and second separate shelf portions, each having opposed first and second ends;

the first and second shelf portions fixedly spaced apart to form a slot extending completely between the opposed first and second ends of the first and second shelf portions.

4. The bookshelf of claim 3 further comprising:

end plates joined to the first ends and second ends of the first and second shelf portions to fixedly space the first and second shelf portion apart.

5. The bookshelf of claim 1 further comprising:

a transverse slot extending outwardly from opposite sides of the longitudinal slot and extending substantially along the length of the longitudinal slot; and the lock means having an end disposed in the transverse slot releasably engagable with the shelf.

6. The bookshelf of claim 1 wherein: the transverse slot is internally disposed within the shelf.

7. The bookshelf of claim 1 wherein the connecting means comprises:

a drive rod connected to and extending from the rotatable member, the drive rod having a threaded end; and a nut having a threaded bore threadingly receiving the threaded end of the drive rod.

8. The bookshelf of claim 1 wherein the book support member comprises:

one planar member; and a bore extending through the one planar member and receiving the lock means therein.

9. The bookshelf of claim 8 further comprising:

grip means, carried on the one planar member, for facilitating gripping of the one planar member.

10. A bookshelf with at least one adjustable bookend mounted thereon, the bookshelf comprising:

a shelf having top and bottom surfaces and opposed longitudinally spaced first and second ends;

a longitudinal slot formed in and extending longitudinally between the first and second ends of the shelf;

a book support member movably disposed on the top surface of the shelf the book support member including:

a first planar book support;

a second support fixedly joined to the first planar support; and a bore extending through the joined first and second supports; and lock means, movably carried in the bore in the book support member and releasably engagable with the longitudinal slot in the shelf, for releasably locking the book support member in a selectively adjustable position along the length of the shelf.

* * * * *